US006382610B1

(12) United States Patent
Corbin

(10) Patent No.: US 6,382,610 B1
(45) Date of Patent: May 7, 2002

(54) CHAIN SLIP TOOL FOR CHAIN VISE

(76) Inventor: Ronnie L. Corbin, PMB 288, 221 E. Market St., Iowa City, IA (US) 52245

( * ) Notice: Subject to any disclaimer, the term of this patent is extended or adjusted under 35 U.S.C. 154(b) by 0 days.

(21) Appl. No.: 09/928,387

(22) Filed: Aug. 13, 2001

Related U.S. Application Data

(60) Provisional application No. 60/225,442, filed on Aug. 14, 2000.

(51) Int. Cl.[7] ..... B25B 1/04

(52) U.S. Cl. ..... 269/130; 269/139; 269/224; 269/131

(58) Field of Search ..... 269/130, 131, 269/132, 224, 139, 70, 95, 97–98

(56) References Cited

U.S. PATENT DOCUMENTS 3,669,439 A * 6/1972 Sanchez ..... 269/130
3,704,503 A * 12/1972 Haywood ..... 29/200 P
3,805,646 A * 4/1974 Knight ..... 81/69
4,184,666 A * 1/1980 Boitz ..... 269/98
5,135,208 A * 8/1992 Diskin ..... 269/130

* cited by examiner

*Primary Examiner*—Joseph J. Hall, III
*Assistant Examiner*—Daniel Shanley
(74) *Attorney, Agent, or Firm*—Allan L. Harms

(57) ABSTRACT

A tool to reduce the rotational force on a pipe to be held in a chain vise includes a curvilinear or inverted V-shaped base which saddles the pipe to be held. A U-shaped frame is mounted to the base such that one or more roller bearings may be mounted between the opposing sides of the U-shaped frame. The roller bearings provide a bearing surface for the chain of the chain vise, allowing the chain to be tensioned without applying torque to the pipe to be held. A pair of the tools may be spaced apart upon the periphery of a large pipe with the chain passing over the roller bearings of each tool.

10 Claims, 5 Drawing Sheets

CHAIN SLIP TOOL FOR CHAIN VISE

CROSS-REFERENCE TO RELATED APPLICATIONS

This application claims priority from provisional patent application entitled "Chain Slip Tool for Chain Vise", Ser. No. 60/225,442 filed Aug. 14, 2000. The disclosure of provisional patent application Ser. No. 60/225,442 is hereby incorporated in its entirety.

STATEMENT REGARDING FEDERALLY SPONSORED RESEARCH OR DEVELOPMENT

Not Applicable.

BACKGROUND OF THE INVENTION

This invention pertains to clamping of pipes with use of a chain vise. The chain vise is a well known tool consisting of a V-shaped cradle on which a pipe rests, and a roller chain of links used to overlie the pipe and be tightened. When so clamped, the pipe may rotate as the chain is tightened about the pipe. Since pipe to be welded is oriented specifically to allow an accurate weld, rotation during tightening is an undesirable result, resulting in the necessity to release the vise, position the pipe, and retighten the chain vise.

BRIEF SUMMARY OF THE INVENTION

The present invention is a tool to reduce the rotational force on a pipe to be held in a chain vise. The invention comprises a curvilinear or inverted V-shaped base which saddles the pipe to be held. A U-shaped frame is mounted to the base such that one or more rollers may be mounted between the opposing sides of the U-shaped frame. The rollers provide a bearing surface for the chain of the chain vise, allowing the chain to be tensioned without applying torque to the pipe to be held.

In an alternate embodiment a pair of the tools are joined by a spacing handle such that the tools may be rested upon the upper surface of a large pipe, with the chain of the chain vise passing over the roller of each of the tools.

It is an object of the invention to provide an improved chain vise which effectively clamps a pipe while reducing the tendency of the held pipe to rotate as the vise chain is tightened.

It is a further object of the invention to provide an inexpensive yet effective tool to be used with an existing chain vise to avoid rotation of a pipe held by the device to rotate as the chain is tightened.

It is another object of the invention to make the welding of pipe sections more efficient by providing a tool which eliminates rotational force on a pipe held in a chain vise.

These and other objects of the invention will become apparent from examination of the description and claims which follow.

DESCRIPTION OF THE DRAWING FIGURES

DETAILED DESCRIPTION OF THE INVENTION

Figure 1:
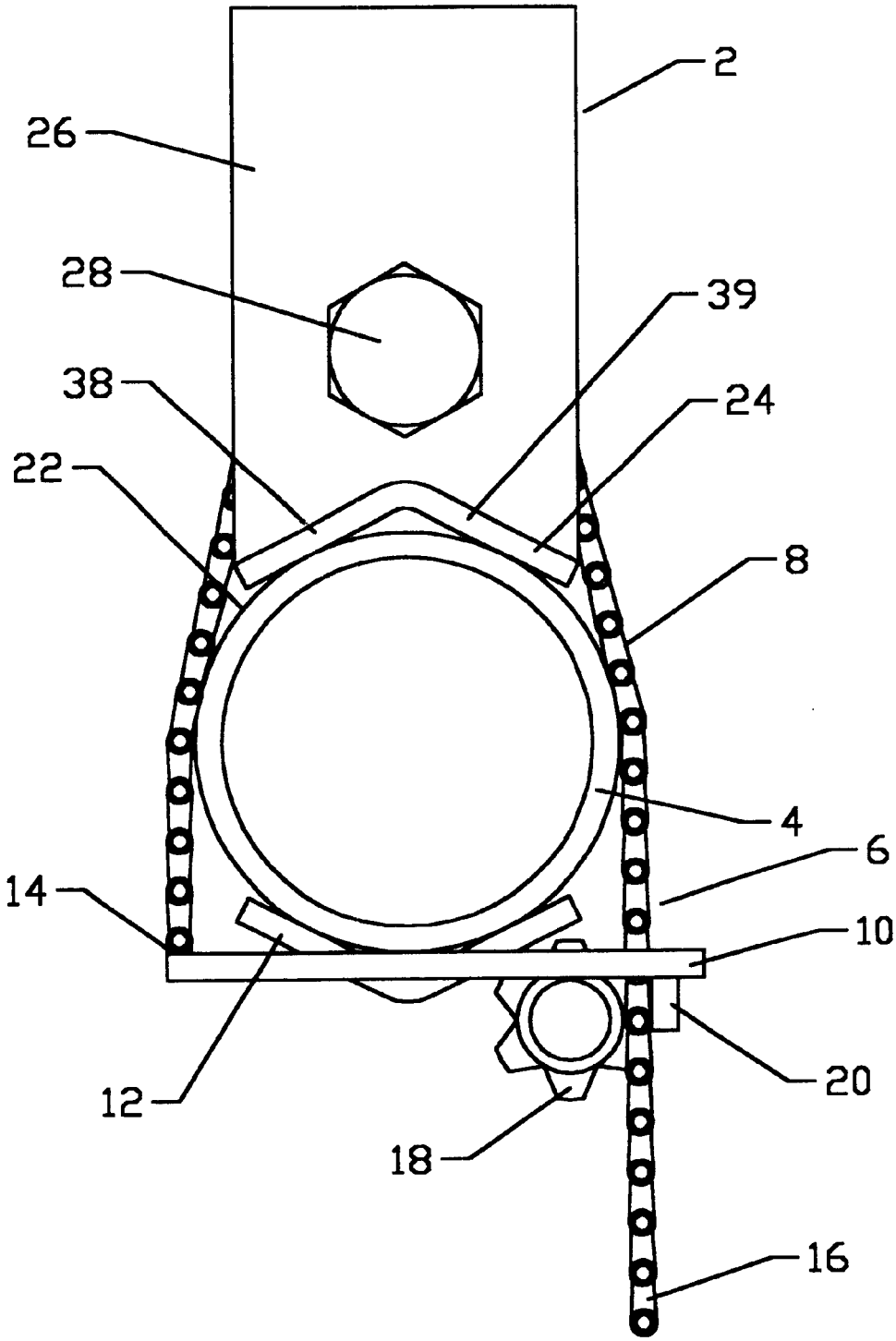
FIG. 1 is a front elevational view of the preferred embodiment of the invention resting upon a pipe held by a chain vise.

FIG. 1 is a front elevation of a pipe 4 gripped in a chain vise 6 with the invention 2 in position on top of the pipe 4, with the chain 8 of the chain vise 6 passing through the invention 2. The chain vise 6 includes a table 10 on which a cradle 12 is mounted. One end 14 of the chain 8 of the chain vise 6 is fixed to the table 10. The opposing end 16 of the chain 8 is free and a sprocket wheel 18 mounted to the table 10 engages the chain 8 to draw chain 8 tight around pipe 4. A guide 20 retains the chain 8 in engagement with sprocket wheel 18.

When invention 2 is not used, the chain 8 overlies pipe 4 and as the sprocket wheel 18 is turned to draw the chain 8 taut about pipe 4, friction of chain 8 on pipe 4 may tend to rotate the pipe 4. Such rotation is undesirable when the pipe 4 has been specifically oriented for welding or similar purposes.

Invention 2 rests upon upper region 22 of pipe 4. Invention 2 comprises a downwardly concave base 24 which is shaped as an inverted V and generally mirrors the V-shape of cradle 12 of the typical chain vise 6. The angle between legs 38, 39 of base 24 is obtuse, preferably about one hundred thirty-two degrees. Base 24 may alternatively be shaped in a curve to conform to the circumference of pipe 4 but it is found that the inverted V-shape of the preferred embodiment of invention 2 shown in FIG. 1 is satisfactory for use with pipes of various diameters. Frame 26 of invention 2 is fixed to base 24 by welding or similar permanent means. Pin 28 extends transversely through frame 26. Invention 2 may be made in various sizes in order to accommodate a wide range of pipe sizes which may be held by chain vise devices.

Figure 2:
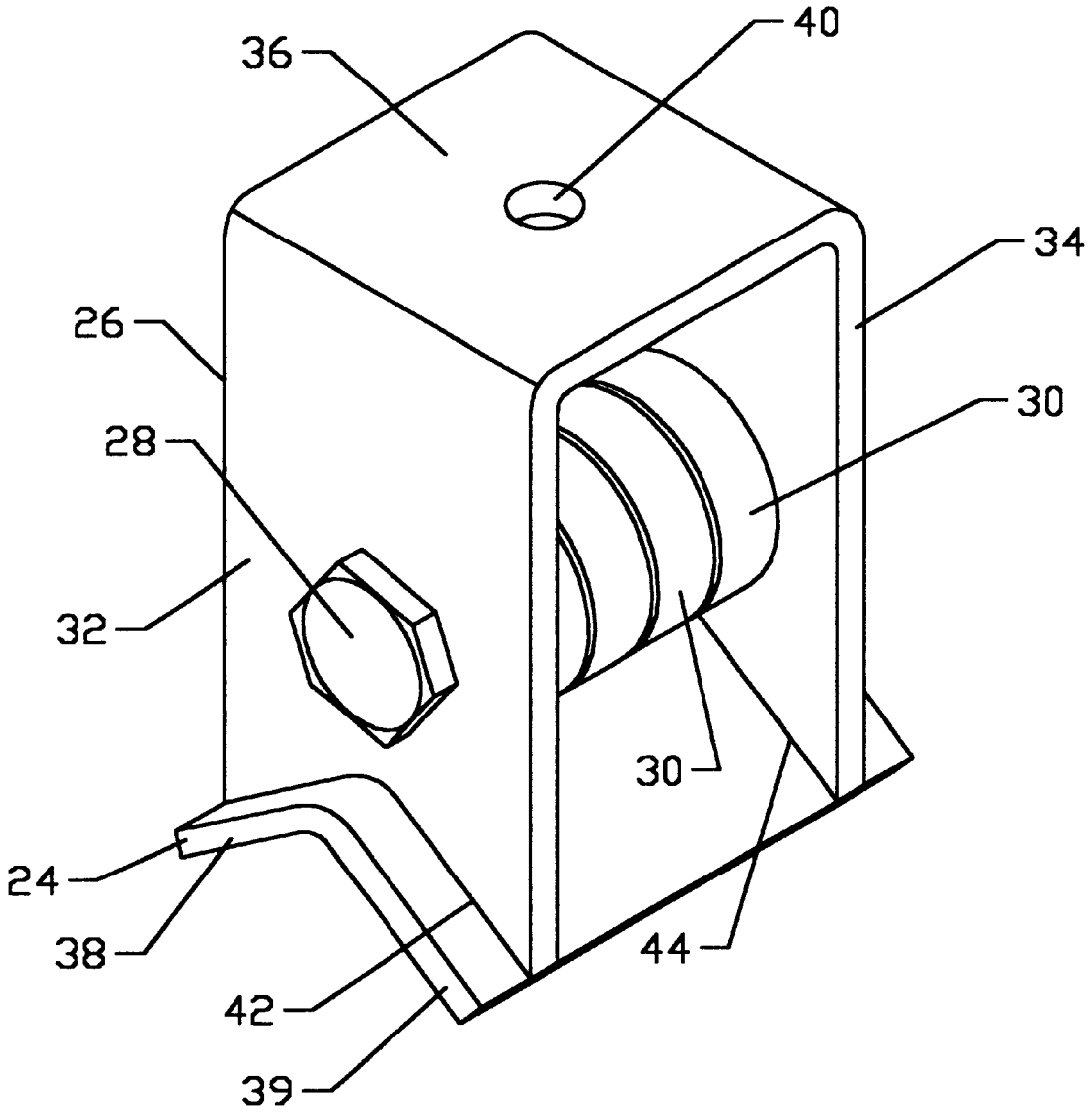
FIG. 2 is a perspective of the preferred embodiment of the invention.
Figure 3:
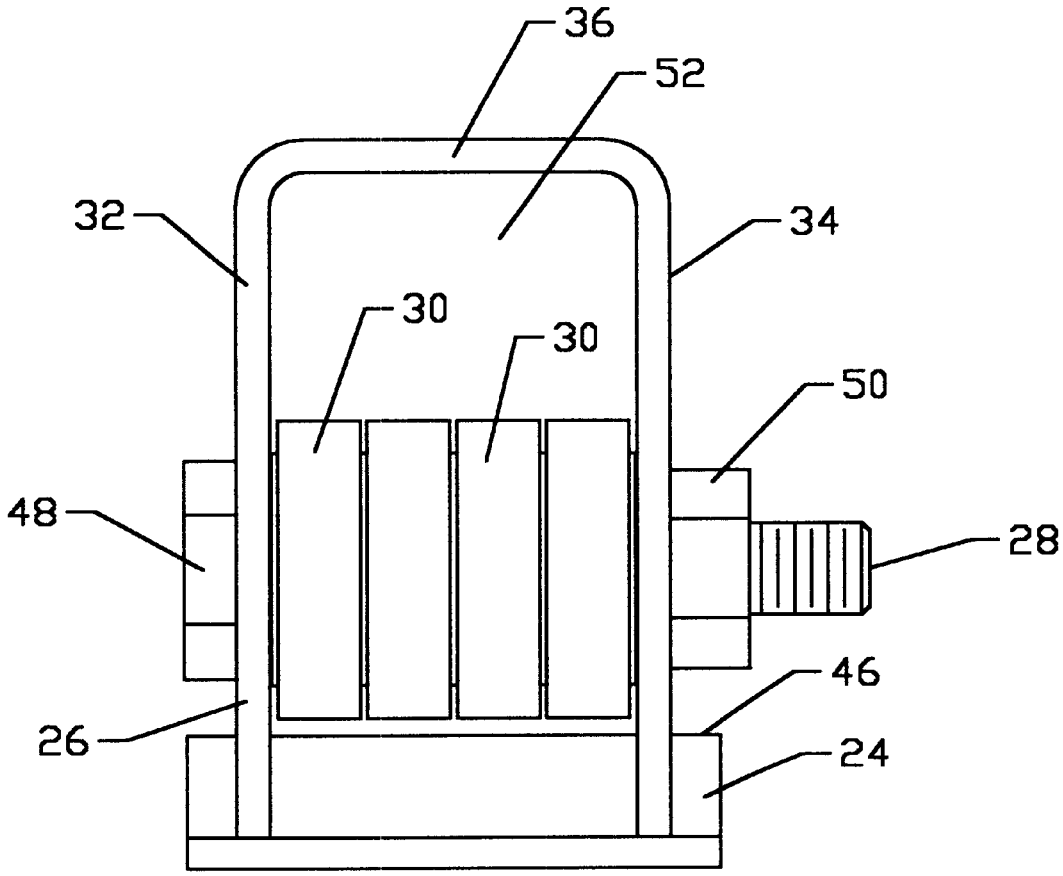
FIG. 3 is a side plan view of the invention.
Figure 5:
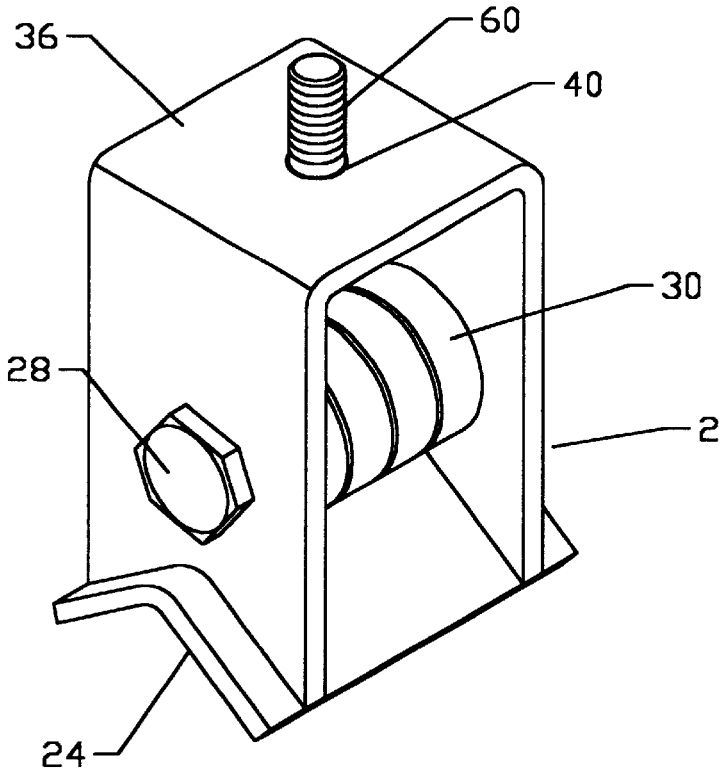
FIG. 5 is a perspective view of the preferred embodiment provided with a mounting bolt extending from the top thereof for use with the alternate embodiment of FIG. 4.
Figure 6:
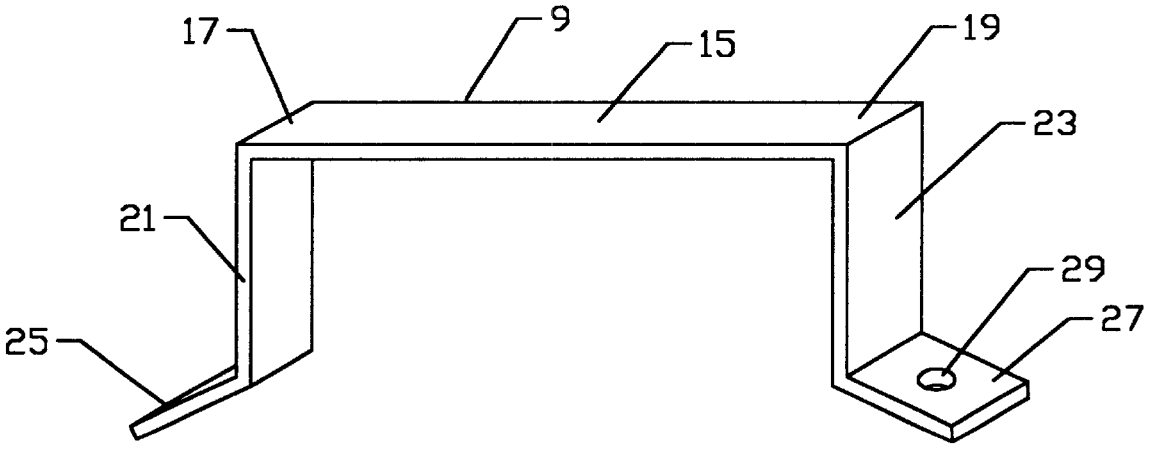
FIG. 6 is a perspective view of the spacer of the alternate embodiment of FIG. 4.

Referring now to FIGS. 2 and 3, invention 2 includes multiple roller bearings 30 supported on pin 28. A single wide roller bearing could be substituted for the multiple roller bearings 30 of the preferred embodiment shown in FIG. 2. Base 24 supports U-shaped frame 26 which includes opposing spaced apart substantially parallel plates 32, 34 joined by top wall 36. In the preferred embodiment of invention 2, plates 32, 34 are each perpendicular to top wall 36 and are formed of an integral segment of material, preferably steel. The plates 32, 34 each have lower edges 42, 44 which are formed in the shape of an inverted V to conform to the shape of base 24. Lower edges 42, 44 are welded to base 24. It can be seen that base 24 extends further than the length of top wall 36 to provide areas for exterior welds to be made between lower edges 42, 44 and base 24. A hole 40 may be machined, stamped, or formed in top wall 36 for use in an alternative application as shown in FIGS. 4–6 and described below.

Each of roller bearings 30 may freely rotate about pin 28 independent from the others of roller bearings 30 and without friction upon either of plates 32, 34. Pin 28 serves as an axle for roller bearings 30 and is supported by plates 32, 34. Pin 28 is oriented substantially in parallel to the ridge 46 of base 24 and to the axis of pipe 4. Pin 28 is preferably oriented at a perpendicular to each of plates 32, 34. Pin 28 may be a bolt provided with head 48 and held in position by lock nut 50.

It is to be understood that the chain 8 of the chain vise 6 of FIG. 1 passes through void 52 between roller bearings 30 and top wall 36 and rests upon roller bearings 30. As the chain 8 is drawn taut, rotational force on pipe 4 is reduced because the roller bearings 30 rotate freely on pin 28 while downward force is exerted on the upper region 22 of pipe 4 by invention 2.

Figure 4:
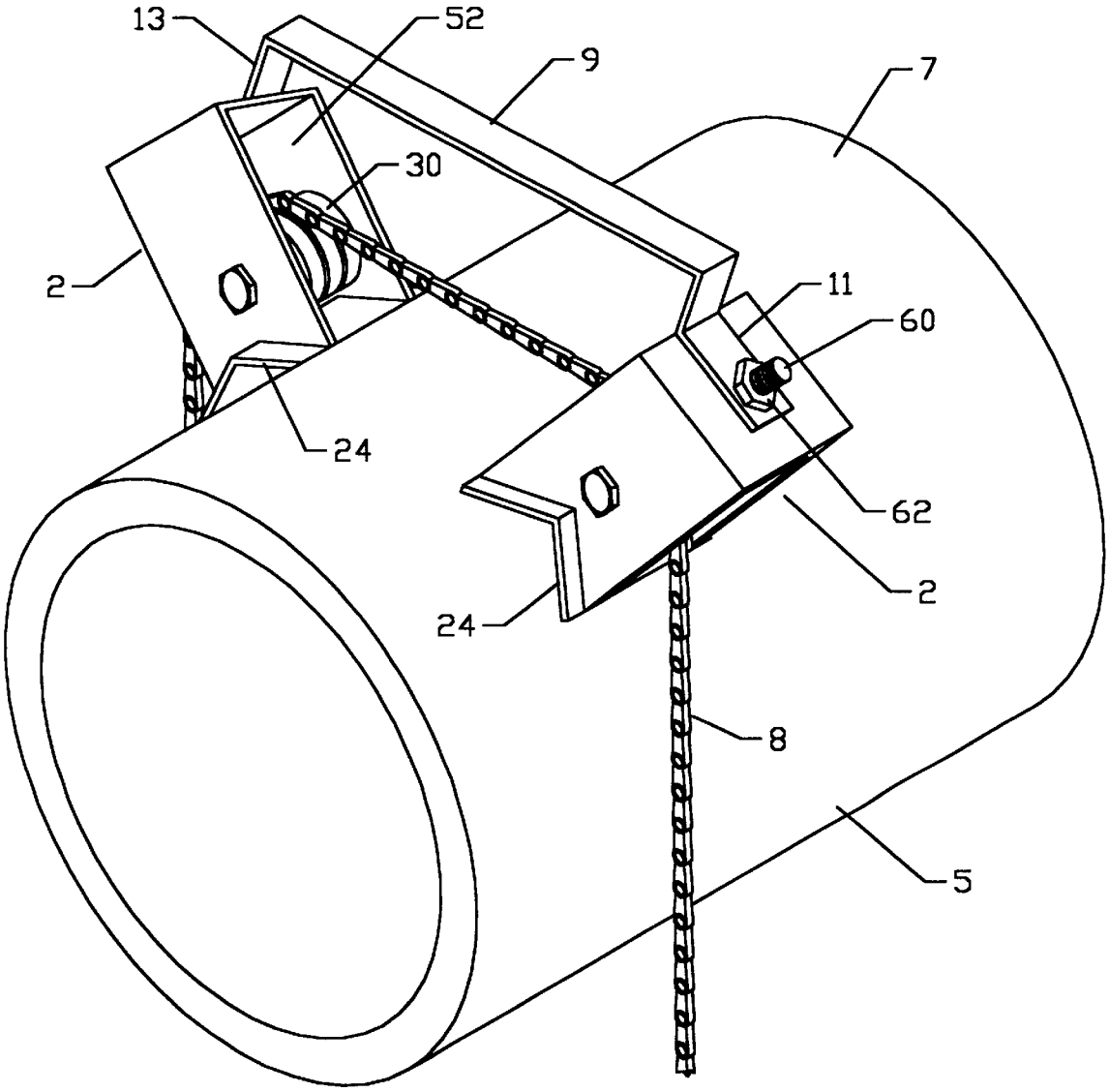
FIG. 4 is a perspective view of an alternate embodiment of the invention having two units of the preferred embodiment of the invention mounted to a spacer with the alternate embodiment resting on a large diameter pipe and having a chain passing through each of the units.

FIG. 4 illustrates an alternative use of invention 2 wherein two or more of inventions 2 are used with a larger pipe, such as large diameter pipe 5 of FIG. 4. In this alternate application, each of inventions 2 are placed on opposing sides of the apex 7 of pipe 5 and inventions 2 are tied together by strap 9. The chain 8 of a typical chain vise may be passed through the void 52 of each of inventions 2 to rest on roller bearings 30 thereof. Strap 9 is retained at each end 11, 13 thereof to inventions 2 by bolts 60 and retaining nuts 62. Strap 9 is of sufficient length to enable invention to be spaced apart while remaining on the upper part of pipe 5.

FIG. 5 shows the invention 2 equipped with bolt 60 mounted in hole 40 of top wall 36 to provide mounting means for use with strap 9 which is shown in FIG. 6.

FIG. 6 shows strap 9 isolated from inventions 2. Strap 9 comprises an elongate linear handle 15 at the opposing ends 17, 19 of which are fixed legs 21, 23 respectively which depend from handle 15. Extending outward from each of legs 21, 23 are brackets 25, 27 which are mounted to legs 21, 23 at an obtuse angle. Each of brackets 25, 27 is provided with an opening 29 which may receive bolt 60 of an invention 2 which may be retained to one of brackets 25, 27 by a nut 62 (FIG. 4). The obtuse angle of brackets 25, 27 relative to legs 21, 23 respectively, is chosen to permit inventions 2 to rest at their bases 24 upon the circumference of large diameter pipe 5. Handle 15 may be made of somewhat resilient material to allow bending thereof to permit the bases 24 of inventions 2 to rest evenly on the pipe.

Having described the invention, I claim:

1. A chain slip tool for use with a chain vise comprising a pair of spaced apart generally parallel plates, each plate having a first edge adapted to generally conform to the periphery of a pipe to be clamped in the chain vise, a pin supported by said plates at a substantial perpendicular thereto, the pin generally parallel to the axis of the pipe to be clamped, at least one roller supported on the pin and freely rotatable thereabout, whereby the first edges of said plates abut the pipe to be clamped by the chain vise.

2. The chain slip tool of claim 1 wherein a base shaped to generally conform to a curvilinear surface is fixed to the first edges of each of said plates.

3. The chain slip tool of claim 1 wherein the at least one roller extends substantially the entire length of the space between the plates of the bearing member.

4. The chain slip tool of claim 1 wherein a transverse wall joins the plates.

5. The chain slip tool of claim 2 wherein the base defines an inverted V, the at least one roller comprises a multiplicity of roller bearings disposed coaxially, the multiplicity of roller bearings extends substantially the entire length of the space between the plates of the bearing member, a transverse wall joins the plates, the transverse wall formed integrally with the plates, the plates and the transverse wall defining an inverted U.

6. A chain vise comprising a cradle to support a pipe to be clamped, a chain having a first end fixed to the cradle, the chain having a second free end, the second free end of the chain selectively drawn toward the cradle, a bearing member disposable upon the pipe to be clamped comprising a pair of spaced apart generally parallel plates, each of the pair of plates having a first edge adapted generally to conform to the periphery of the pipe to be clamped, an axle supported by said plates, the axle disposed substantially parallel to the axis of the pipe to be clamped, at least one roller supported on said axle and freely rotatable thereabout, the chain passing over the at least one roller.

7. The chain vise of claim 6 wherein a pair of spaced apart bearing members is joined by a spacer, each of said bearing members substantially identical to the other of said bearing members, each pair of plates of each bearing member abutting at the first edges thereof the periphery of the pipe to be clamped.

8. The apparatus of claim 7 wherein the spacer comprises an elongate strap adapted to mount to each of said units.

9. A method to clamp a first pipe to be welded to a second pipe, comprising the steps of:

positioning the first pipe on a cradle, placing a first bearing member upon the pipe generally overlying the cradle, the first bearing member comprising a pair of spaced apart, generally parallel plates, each plate having a first edge adapted to generally conform to the periphery of a pipe to clamped in the chain vise, a pin supported by said plates, the pin disposed substantially in parallel with the first pipe, at least one roller supported on the pin and freely rotatable thereabout, passing an elongate chain over the roller of the bearing member the chain having a first end and an opposing second end, fixing the first end of the chain to the cradle, drawing the second end of the chain past the cradle.

10. The method of claim 9 further including the steps of:

placing a second bearing member on the pipe, the second bearing member being substantially similar to the first bearing member, remaining the first bearing member and the second bearing member in a spaced apart relation whereby the pins of the bearing members are generally parallel, passing the chain over the roller of the second bearing member before drawing the second end of the chain past the cradle.

* * * * *